United States Patent [19]

Dutton

[11] Patent Number: 4,984,530

[45] Date of Patent: Jan. 15, 1991

[54] HAND WASH TOWEL DISPENSING SYSTEM

[75] Inventor: Virgil R. Dutton, Chandler, Ariz.

[73] Assignee: Core Medical Corporation, Scottsdale, Ariz.

[21] Appl. No.: 263,392

[22] Filed: Oct. 27, 1988

[51] Int. Cl.[5] ..... B05C 11/00

[52] U.S. Cl. ..... 118/43; 118/235; 118/419; 118/423; 134/18; 134/26; 134/40; 422/1; 242/55.3; 242/55.53

[58] Field of Search ..... 221/135, 93, 96, 123; 222/190, 183, 1; 134/15, 38, 40, 26, 25.4, 39, 18; 422/1, 266, 269, 271, 292; 68/13 R; 118/37, 40, 43, 231, 244, 248, 249, 400, 419, 423, 427, 429, DIG. 17; 242/55.3, 55.53

[56] References Cited

U.S. PATENT DOCUMENTS

| | | | |
|---|---|---|---|
| 2,044,284 | 6/1936 | Dargavel | 221/135 X |
| 2,457,293 | 12/1948 | Winzer | 118/419 X |
| 2,789,725 | 4/1957 | Carper | 221/135 X |
| 3,025,829 | 3/1962 | Smith | 118/221 |
| 3,084,664 | 4/1963 | Perlman et al. . | |
| 3,368,522 | 2/1968 | Cordis | 118/43 |
| 3,388,953 | 6/1968 | Browning | 118/221 X |
| 3,775,801 | 12/1973 | Walker | 118/43 X |
| 3,865,271 | 2/1975 | Gold | 221/96 |
| 4,620,502 | 11/1986 | Kimble | 118/43 X |
| 4,664,058 | 5/1987 | Schroeder | 422/292 X |
| 4,747,365 | 5/1988 | Tusch | 118/221 |

*Primary Examiner*—Andres Kashnikow
*Assistant Examiner*—Gregory L. Huson

[57] ABSTRACT

A towel dispenser contains two rolls of paper. A bar on the front, when pushed, delivers a short length of wet towel and a short length of dry towel, simultaneously. It also guides the towel dispensed from one of the rolls through a bath of antiseptic hand-cleansing solution. It also releases the system to enable pulling an additional length of toweling from each of the two rolls. Upon release, either towel can be pulled out further manually to produce about ten more inches of towel. The toweling is delivered from both rolls simultaneously, but the towels are used in sequence, the wet towel first and the dry towel next.

29 Claims, 5 Drawing Sheets

HAND WASH TOWEL DISPENSING SYSTEM

BACKGROUND OF THE INVENTION

This invention relates generally to towel dispensers, and more particularly to a dispenser for both wet and dry towels.

DESCRIPTION OF THE PRIOR ART

For many years, disposable towels, usually made of paper or derived from paper products, stored and dispensed from wall-mounted dispensers, have been commonplace in public restrooms and other facilities. As a result of the increasing attention given in recent years in connection with efforts to protect from nosocomial infections, the essential impracticality of conventional paper towel or fabric roll towel dispensing is realized. It is desirable that hands be washed and, in some applications, an antiseptic supplied. Hot water is not always available, nor is a soap or hand washing liquid, nor is there assurance that such cleaners would have proper antiseptic properties.

Efforts have been made to provide suitable dispensers for dispensing wet and dry towels. An example is the U.S. Pat. No. 3,388,953 issued to Browning on June 18, 1968. FIG. 2 of that patent shows an arrangement where, with the handle 48 in the upward position 49, dry towels 15 can be dispensed. With the handle 48 in the downward position 50, the wetting belt 20 is engaged by the towel 15 as the belt forces the toweling against the counter pressure surface of roller 37, to wet the towel being dispensed. An earlier U.S. Pat. No. 3,084,664 issued to Perlman et al. on Apr. 9, 1963 discloses an arrangement where, with the button 73 pushed, dry toilet paper is dispensed, but with the button 72 pushed, the toilet paper web 26 is pressed upon the upper surface of the wetting roller 59 to dispense wet toilet paper.

Other patents which disclose wet towels include U.S. Pat. No. 3,025,829 issued to Smith on Mar. 20, 1962, U.S. Pat. No. 3,368,522 issued to Cordis on Feb. 13, 1968 and showing several ways of wetting roll toweling and also stacked sheet toweling, and U.S. Pat. No. 4,620,502 issued to Kimble on Nov. 4, 1986 and showing a belt means for dispensing wet toweling from a roll.

There is a U.S. Pat. No. 4,747,365 issued to Tusch on May 31, 1988 and showing a system for dispensing dry or wet toilet paper from a dispenser. By pushing down handle 13, the guide roll 9 forces the paper from roll 3 against a pick-up roller which applied medicament to the paper from the reservoir 4. FIGS. 4 and 5 show two different arrangements of roller parts **22*a* and 22*b* in FIG. 4, or 22*c* in FIG. 5 as alternative arrangements of pick-up roller and which do not wet the entire width of the paper so as to leave part of it dry enough not to destroy its strength and thereby preclude withdrawal from the dispenser. The Smith U.S. Pat. No. 3,025,829 uses spaced sponge sleeves 31 to avoid wetting the central portion of the paper as it passes over the pick-up roller 29** and thereby avoid weakening the paper which might otherwise tear at the point between the pressure roller and pick-up roller.

It is evident from several of the foregoing patents, particularly the Smith patent and the Tusch patent, that there is a problem dispensing wet paper due to the loss of strength when it is wetted. Those patents attempted to deal with the problem by wetting only a part of the width of the sheet. Also, for the paper to have suitable hand-cleaning qualities, it will tend to use excessive amounts of liquid while being wetted in the dispenser. This results in expense of liquid, extra maintenance of the liquid reservoir, or additional space requirement to store additional volumes of the liquid. Thus, there has remained a need for a better wet/dry towel dispenser. The present invention addresses this need.

SUMMARY OF THE INVENTION

Described briefly, according to a typical embodiment of the present invention, a towel dispenser includes two supplies of toweling material in dry roll form. Both supplies are dry. A dispenser initiating system includes a push-operated member for initially dispensing short lengths of toweling from both rolls to a dispensing position. This operation also initiates wetting of the toweling dispensed from one of the rolls. It also releases the system to enable the user to pull an additional predetermined length of toweling from each of the two rolls. The length from one is suitably dampened as the toweling is pulled, while the length from the other roll is dry. As the wet towel is pulled, the dry towel is automatically dispensed at the same time. They are used in sequence, the wet towel first and the dry towel next. Any suitable wetting agent, including water, detergent, soap, antiseptic and/or other media to be applied to the wet towel, can be used. The towels in the two supplies differ in absorbency, texture and other physical and chemical characteristics, as desired.

DESCRIPTION OF THE PREFERRED EMBODIMENT

Figure 1:
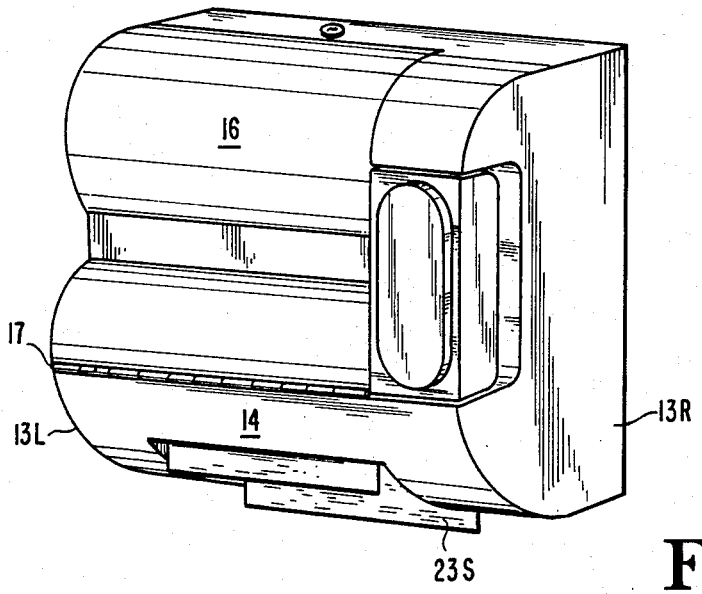
FIG. 1 is a pictorial view of a towel dispenser according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 3:
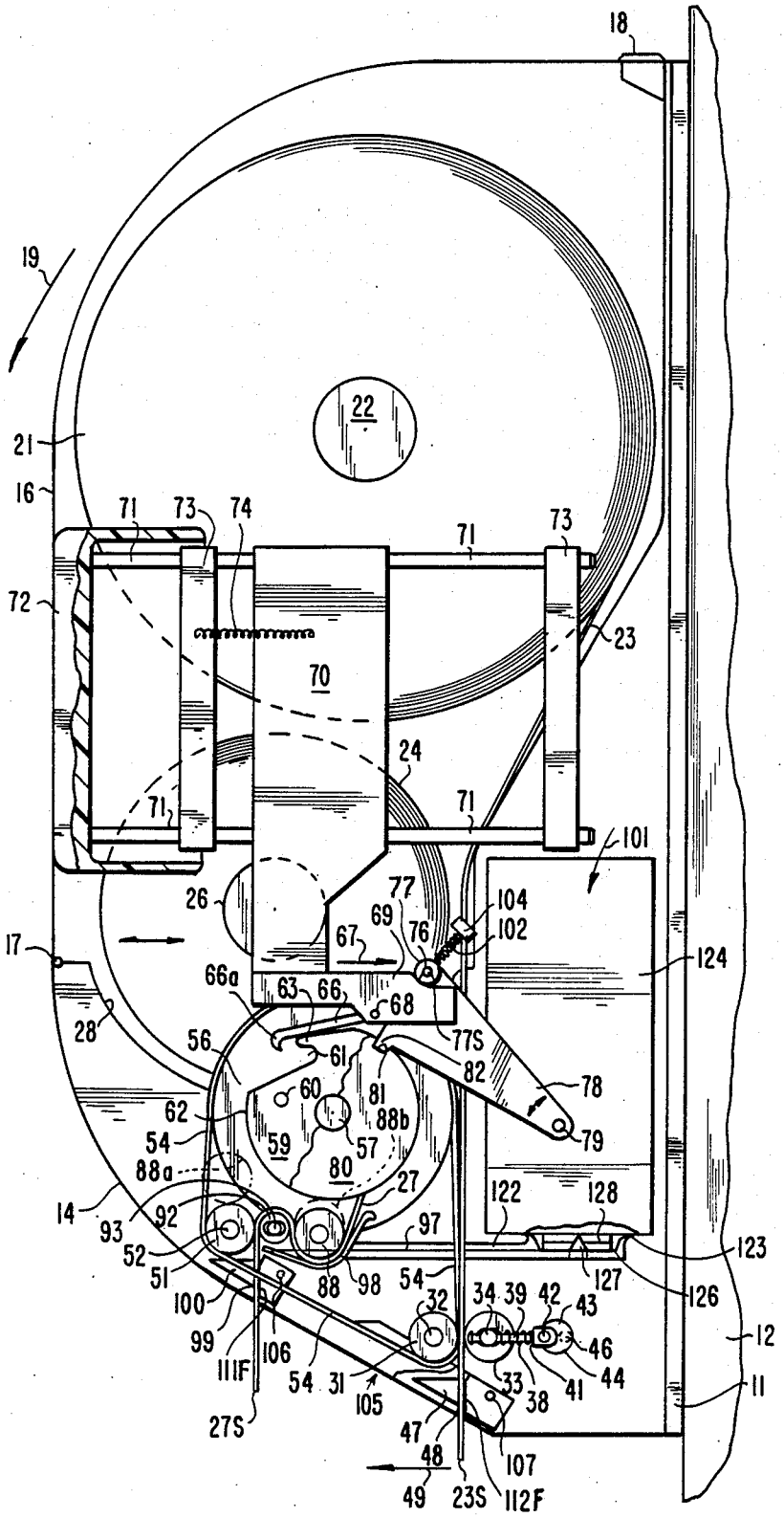
FIG. 3 is a side sectional view of the dispenser taken at the line 3—3 in FIG. 2 and viewed in the direction of the arrows but omitting the roller side frame.

Referring now to the drawings in detail, the dispenser includes a back plate 11 mounted to the building wall 12. The housing includes side walls 13R and 13L projecting forward from the back plate, and a lower front wall 14 extending across the front. A cover 16 is hinged to the top of wall 14 at 17 and latched at the top at 18 to the back wall whereby the cover can be swung out from the back plate in the direction of arrow 19 (FIG. 3). The cover extends to back plate 11 at the top and the left side above the level of the hinge 17 to facilitate installation of toweling.

A roll 21 of drying towel material is placed in the housing for rotation about a shaft 22 to deliver a web 23 of drying towel material down through the housing. A roll 24 of cleaning towel material is placed in the housing for rotation about a shaft 26 to deliver a web 27 of cleaning towel material down through the housing. Alternatively, both of these rolls may be provided in a single removable cartridge sitting in a cradle (not shown) in the housing. In that case too, the rotational axes of the towels would be in the same location, as the axes of shafts 22 and 26. In any case, the materials in both rolls of material is dry. That delivered from one roll is subsequently wetted to enhance its cleaning ability, so it may be referred to hereinafter as "cleaning" towel or "wet" towel or "washing" towel.

A drying towel feed roller 31 is secured on shaft 32 rotatably mounted on two horizontally-spaced roller support side frames 37 (shown in FIG. 2 but not in FIG. 3) fastened to back plate 11 in the housing. A drying towel pinch roller 33 is rotatably mounted on a shaft 34 which is non-rotatably supported at its ends in elongated slots 36 (FIG. 7) in the roller support side frames. The shaft 34 (FIG. 3) is normally urged forward in the slot 36 at each end of the shaft by a spring 38 mounted on a guide pin 39. The pin 39 is actually a screw passing through a transverse hole in the shaft 34 and threaded into a combination pin mount and spring seat 41 pivotally mounted at pin 42 which is eccentrically mounted to the end of cam shaft 43 mounted in apertures 44 in side frames 37. One end of each spring 38 seats on shaft 34. The other end seats on seat 41. Shaft 43 is normally indexed to a rotational position where eccentric pin 42 is located as shown in the solid lines in FIG. 3 whereupon springs 38 urge the pinch roller forward against the web 23 urging it against the drive roller 31. Shaft 43 can be manually turned 180° in holes 44 to a pinch roller release orientation where eccentric pins 42 are in the dotted line position 46 in FIG. 3. As this occurs, the heads of screws 39 engage and pull shaft 43 rearward causing the pinch roller to separate from the towel web 23 and drive roller 31 to permit freely feeding the web 23 down through it. This is useful for loading the dispenser.

A towel cut-off knife 47 fastened by suitable brackets (not shown) to side frames 37 has the cut-off edge 48 located at a drying towel dispensing station where the strip 23S of drying towel extending below the edge 48 can be torn off by pulling it forward in the direction of arrow 49.

A washing towel drive roller 51 is secured on shaft 52 rotatably mounted in holes **52*a* in the roller support side frames 37. A sprocket 53 on the outer end of the shaft is coupled by a chain 54 to the sprocket 35 which is at the outer end of shaft 32. This chain goes around sprocket 56 which is rotatably mounted to cam shaft 57 which is mounted between the roller support side frame 37 and the actuating mechanism side frame 58 which is fastened to back plate 11**. While sprockets and chain are mentioned here, gear-belt or other synchronized drive systems may also be used.

Three cams and sprocket 56 are rotatably mounted to the shaft 57. They are non-rotatably fastened to each other by a spring-type connector and indexing pin 60 ("Rollpin", for example). One of these cams, a towel advance cam 59, is a cylindrical disc having a pawl receiving notch 61 on its exterior cylindrical surface 62. Only half of the cam 59 is shown in FIG. 3, so another cam (the release cam) can be seen behind it. Notch 61 is formed to provide a pawl stop 63 engageable by the hooked distal end **66*a* of pawl 66 when the pawl is moved in the direction of arrow 67. The proximal end of the pawl is received in a downwardly opening slot in, and pivotally mounted at 68 to, a linear cam drive body 69 fastened by block 70 to rods 71 connected to the advance push pad 72. The rods 71 are slidable in guide brackets 73 fixed in between the side frames 37 and 58. The push pad, rods and linear cam are all normally held in a position shown in FIG. 3 by the spring 74 which has its front end hooked to the front bracket and its rear end hooked to the block 70**.

Linear cam drive body 69 has a cam ramp 76 on the upper surface thereof. A cam follower roller 77 is received on the upper surface immediately behind this ramp. This roller is a ball bearing assembly whose inner race is fixed on a shaft **77*s* secured to the top corner portion of a generally triangular release latch or "indexing lever" 78 which is pivotally mounted to shaft 79 connected between the side frames 37 and 58. A "release cam" 80 is one of the three cams mounted to shaft 57. It is a cylindrical disc having a single detent notch 81 in its outer cylindrical surface. The release latch 78 has a lug 82 at its lower front end received in the detent notch 81 in the outer cylindrical surface of release cam 80**.

Figure 4:
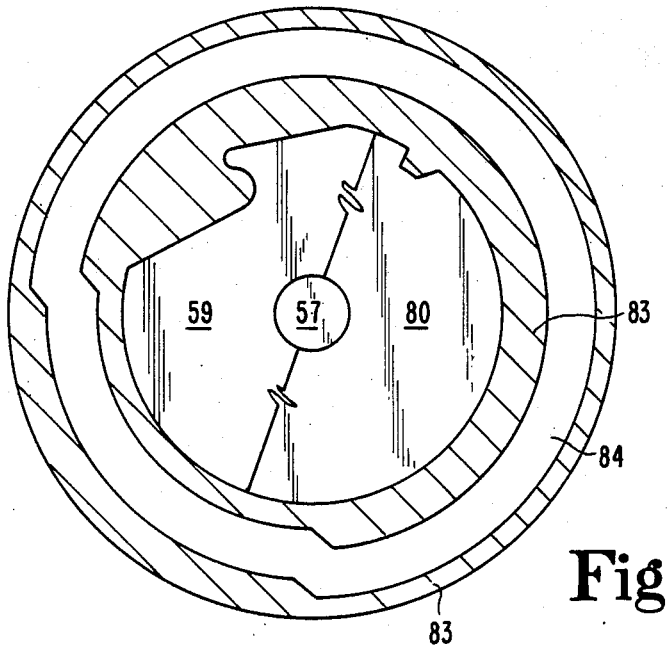
FIG. 4 is a diagram (viewed axially) of the three control cams mounted to a shaft, but omitting the sprocket.
Figure 5:
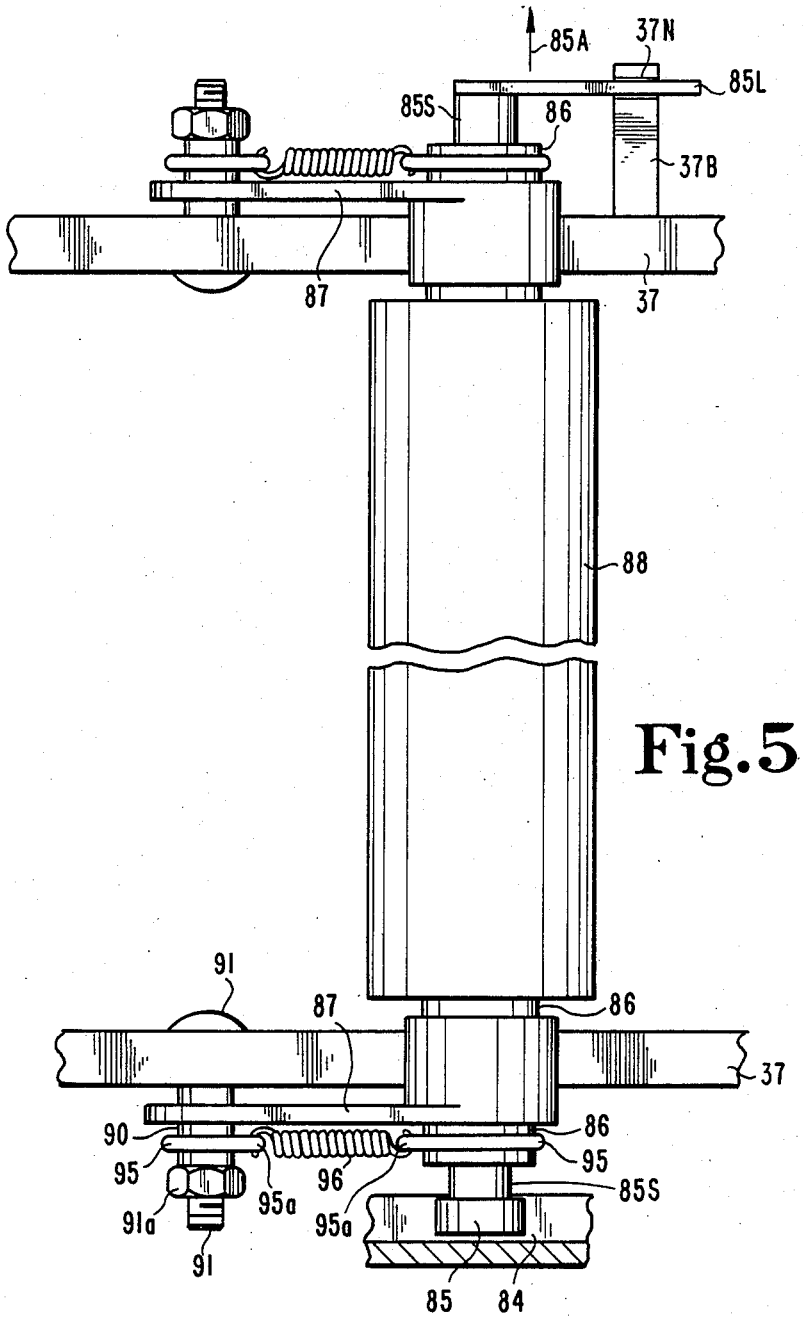
FIG. 5 is an enlarged top view of the wetting roller (with a portion broken out to conserve space) and mounting yoke for it.
Figure 6:
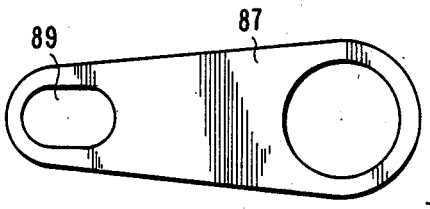
FIG. 6 is a side view of the wetting roller mounting bracket support arm.

A "wetting cam 83" (not shown in FIG. 3) is also mounted on shaft 57 with the other two cams. It is a circular disc with a cam groove 84 (FIGS. 4 and 5) on the inside face thereof in which a follower roller 85 is received. This follower roller 85 is rotatably mounted at the end of a shaft 85S which is rotatably received in bearings in the opposite ends of a tube 86. This tube has a pair of support arms 87 fixed to it near its ends. A wetting roller 88 is rotatably mounted on tube 86. The support arms 87 have horizontally extending slots 89 (FIG. 6) received on spacer bushing 90 fastened to the side frames 37 by screws 91 and nuts **91*a* threaded thereon (FIG. 5**).

A pinch roller 92 is mounted between the rollers 51 and 88, and its shaft 93 is received in slots 94 (FIG. 7) in side frames 37. The pinch roller is urged toward the drive roller 51 by wetting roller 88. This is achieved by the slotted arm and spring loaded mounting arrangement for the wetting roller. Each end of tube 86 has a circumferential groove thereon as does each of the bushings 90. These grooves receive spring anchor rings 95 therein, which are simply snapped over the ends and received in the grooves and have loops as at **95*a* to which the ends of the tension coil springs 95 are hooked. The slots in arms 87 permit springs 96 to pull the wetting roller snugly against the washing toweling web 27 sandwiched between the wetting roller and pinch roller 92. The slots 94 in side frames 37 permit the pinch roller to be pushed snugly against the web 27 between the pinch roller and the drive roller 51**.

The arm 87 mounting arrangement on bushings 90 permits pivoting the wetting roller up and forward from the position shown by the solid outline to the dotted outline position 88*a* to permit threading the washing towel web 27 into the machine when loading the new toweling in it. To swing the wetting roller up, the shaft 85S must be shifted in the direction of arrow 85A (FIG. 5) to get the cam follower roller 85 out of cam groove 84. To shift the shaft, the shaft locating lever 85L is manually raised out of the locating notch 37N in the locating bracket 37B on side frame 37, and the shaft is shifted in the direction of arrow 85A. Then the wetting roller can be swung up to the dotted line position in FIG. 3 for installing the new washing towel web. The cutouts 40 (FIG. 7) in roller side frames 37 accommodate the upward and forward pivoting of the support arms 87. With the wetting roller in the position shown in solid lines in FIG. 3, it is slightly submerged into the reservoir of wetting agent 97 in tray 98 which is secured in the housing. In this position, the web 27 follows a serpentine path under the wetting roller, up between the wetting roller and pinch roller, over the pinch roller and down between the pinch roller and drive roller 51 and out past the cutting edge 99 of the fixed tear-off knife 100 to expose the web end strip 27*s* below edge 99.

The release latch 78 is normally held downward in the direction of arrow 101 by the return spring 102, whose lower end is based on post portion 103 (FIG. 2) of latch body 78. The post portion projects inwardly from latch 78. A pin (not shown) projecting upward from post 103 inside the spring 102 retains the spring in position on the post. The upper end of spring 102 is seated in a socket in bracket 104 secured to the right-hand roller side frame 37.

A clamp unit 105 (FIGS. 3, 7 and 8) is operated in synchronism with the latch 78. To facilitate showing other features, the clamp unit is not shown in FIG. 2. The clamp unit is actually a rectangular frame having parallel front and rear clamp bars 111 and 112 fixed to parallel side plates 105S located just outboard of the roller side frames 37. A bottom plate 105B is secured to bar 111 and side plates 105S and extends downward and rearward to the down curved rear edge 105E located below and ahead of rear cutting edge 48. The clamp unit has front and rear horizontally extending support pins 106 and 107 in bars 111 and 112 and received in identical slots 108 and 109, respectively, of the right side frame 37. Identical pins are received in identical slots in left side frame 37 so the bar is slidable upward from a release position to the applied position of FIG. 7 where clamp faces 111F and 112F of the front 111 and rear 112 clamp bars, respectively, clamp the towel webs 27 and 23 against the knife edges 99 and 48, respectively.

Figure 7:
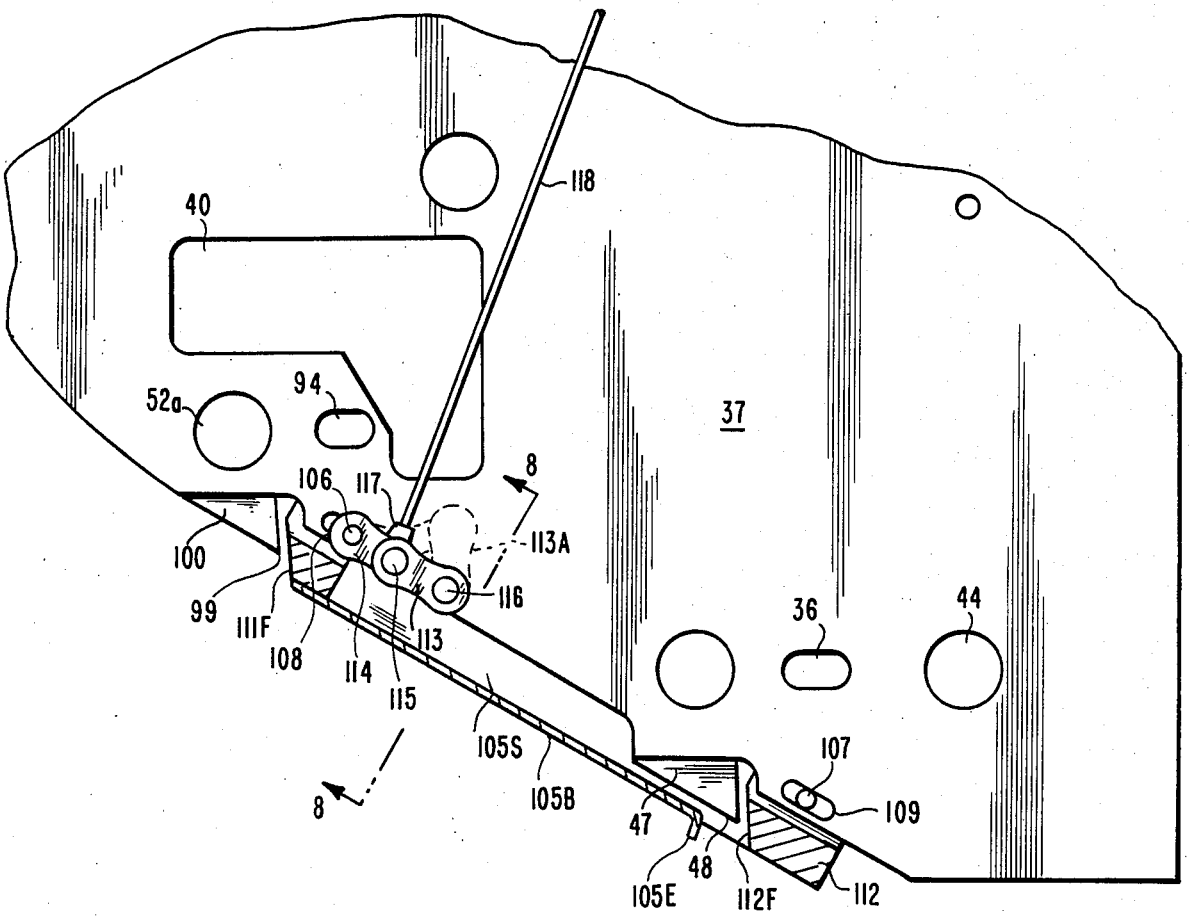
FIG. 7 is an enlarged side view of a lower portion of a side frame with towel clamping unit (shown partially in section) and actuator linkage for it.

To push the clamp bars upwardly to the clamping position shown in FIGS. 3 and 7, links 113 and 114 similar to roller chain links are provided outboard of the side frames 37 at the left and right sides of the dispenser. Link 113 has its lower end secured to shaft 116 which extends through right side frame 37, across to left side frame 37 and through it to its counterpart link 113L. The upper end of link 113 is pinned at 115 to the lower end of link 114. The upper end of link 114 is pinned to the clamp bar 111 at the clamp bar front support pin 106 which is slidable in slot 108 in side frame 37. In this context, the references to "upper" and "lower" ends of link 114 should be understood to refer to that link when in the bar clamping position of FIG. 7, not when the link is in the alternate, bar-release, position shown in FIG. 8 and in dotted lines in FIG. 7.

Figure 2:
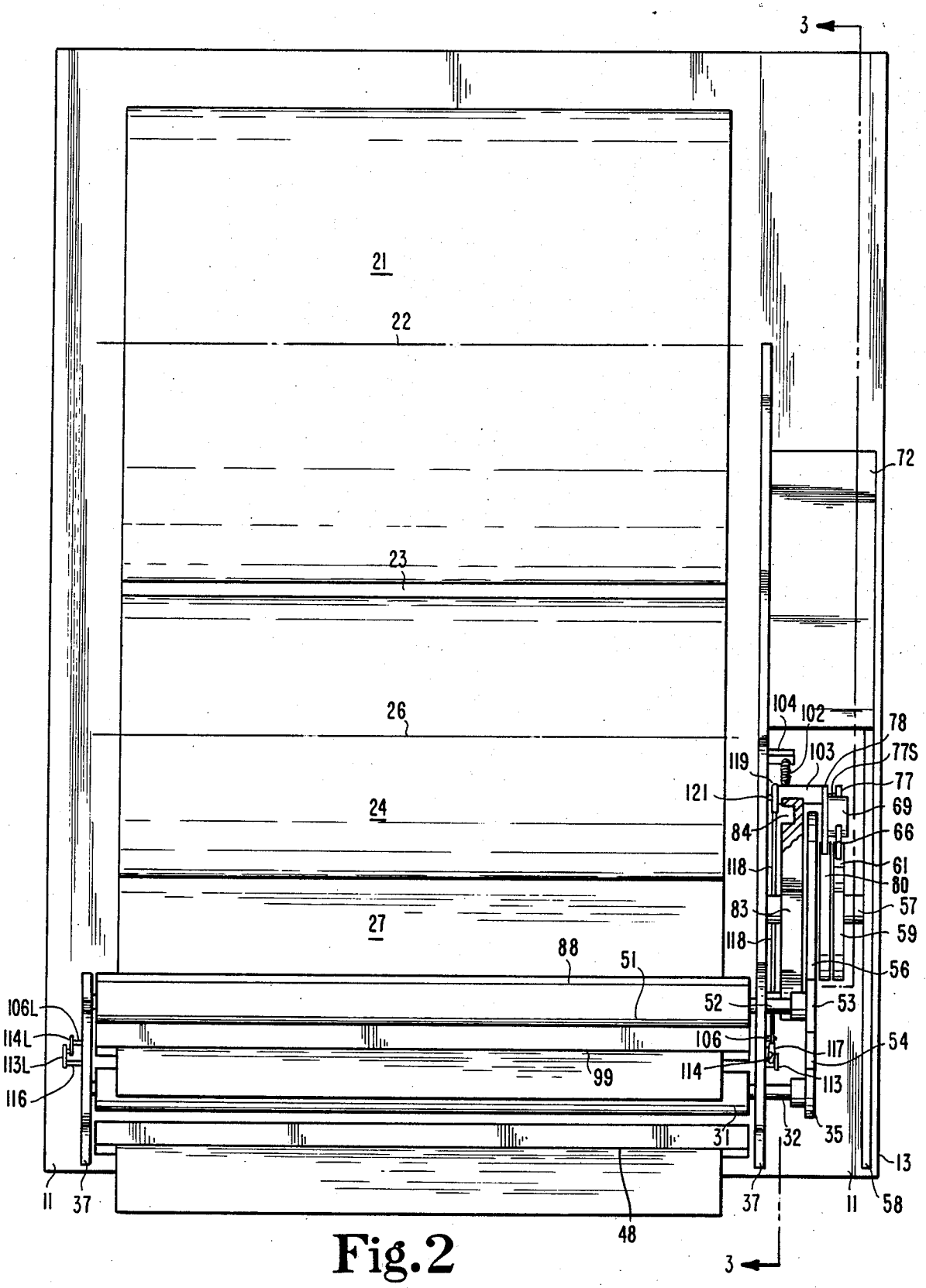
FIG. 2 is a front elevational view thereof but with the housing front omitted to show interior details.
Figure 8:
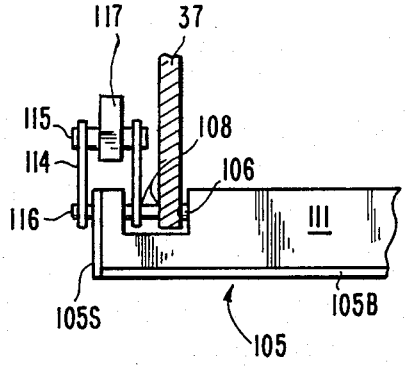
FIG. 8 is a fragmentary view from the rear of a portion of the side frame with clamping unit and support as at line 8—8 and on the same scale as in FIG. 7 but with link 114 turned up to the clamp release position as in the dotted lines of FIG. 7.

At the right side of the dispenser, the pin 115 which connects links 113 and 114 pivotally receives the lower end bearing block 117 of the push rod 118. This is shown in FIGS. 2, 7 and 8, but link 113 is omitted from FIG. 8 to facilitate illustration of the other features. An upper end bearing block 119 is threaded onto the upper end of push rod 118. Block 119 is pivotally mounted on pin 121 (FIG. 2) at the inner end of post 103. Rod 118 is screwed into block 119 to permit adjustment of the clamping force of the clamp bars. Also, the cut-off knives 47 and 100 are adjustable on initial assembly to the side frames 37, or later, if desired, to further adjust clamping force. This is accomplished by providing oversized holes in the side frames 37, for the cut-off knife mounting screws.

The tray 98 is supplied by a wetting agent from trough 122 mounted in the housing and having a circular upper edge ring 123 supporting a container 124 (preferably a two quart size) which is inverted in the housing and has a circular outlet rim 126 defining the level of the liquid in the tray. A diaphragm piercing point 127 is in the bottom of the trough 122 under the center of the liquid container. Therefore, when the container is inserted in the vertical direction and the point 127 pierces the diaphragm or seal 128 in the bottom of the container, liquid therefrom can fill the trough to the level of the rim 126 around the outlet opening. This level is high enough to contact the web 27 as it is fed from the roll around the rollers and out from the dispensing locations.

In operation, upon pushing the pad 72 to the right, advance pawl hook 66*a* will engage the stop 63 and rotate the cam and sprocket pack 59-56 sufficiently that the chain 54 around the sprockets connected to the two drive rolls 31 and 51 will pull approximately one inch of paper from both towels to expose approximately one inch of paper below the knife edges. The space between the hook 66*a* at the end of the advance pawl and the stop 63 at the end of the advance cam 59 is such that there is approximately .25 inches of lost motion of the push pad before rotation of the advance cam is commenced. During this first .25 inches of travel, the ramp 76 on the drive block 69 pushes the release latch up so the detent lug 82 thereof is out of the notch 81 in the release cam 80, enabling the cam to turn. This action also pulls rod 118 upward which pulls the joint between links 113 and 114 upward to the dotted line position in FIG. 7, to release the clamp bars. During the last 1.0 inches of travel of the approximate 1.25 inches total travel of the advance push pad 72, approximately one inch of both towels will become exposed below the lower cutting edges of the knives for the respective towels. Due to the configuration of the wetting cam groove (FIG. 4), the first and last inch of washing towel will be dry. Therefore, the exposed portion of the washing towel will be dry. Then that edge of the washing towel is manually pulled downward, and approximately ten inches more of the towel can be pulled out before the release latch lug 82 again enters the notch 81 of the release cam to stop rotation of it. When that happens, the clamping bars operated by the link 118 between the release latch 78 and the clamping unit will cause the clamping bars to close. The last one inch of the washing towel will be dry because of the wetting roller cam track 84 which lifts the wetting roller out of the wetting agent in the tray to the position shown by dotted line 88b (FIG. 3) during the last 1.0 inch of travel as the toweling is pulled out.

The drying towel is automatically dispensed at the same time the washing towel is pulled out, because of the chain drive from the sprocket at the end of the washing towel feed drive roller also driving the drying towel feed roller. After the release latch has stopped rotation of the release cam, and thereby the advance cam, the pawl will have fallen into the large notch 61 in position ready for the next push of the push pad 72. The washing towel can be torn off to wash the hands. Then the drying towel can be torn off to dry the hands. This procedure is repeated for every towel combination desired.

Any kind of suitable cleaning agent, liquid soap, antiseptic or a two-part type such as "Alcide" can be employed in the liquid container and therefrom to the wetting tray. The washing towel and drying towel materials are different. The washing towel is not as absorbent. Therefore, it does not accumulate large amounts of the wetting agent, nor does it use too much of the wetting agent in too short a time. Even though it is wetted in the tray and is referred to as the "wet" towel, it is not dispensed dripping wet, and the contour of the cam track 84 raises the wetting roller soon enough to enable the non-dipped portions to absorb any extra wetting agents that may be pinched out and accumulate above the drive roller 51. On the other hand, the drying towel is a more absorbent type of towel which has a more luxurious look and feel to it. It may also contain a skin emollient ("moisturizer") to soften the hands. The nature of the materials is such that the drying towel is more absorbent, not only because of greater thickness, but also because of greater absorbency per square inch of web area. Thus, it is more absorbent not only per square inch of web area, but also per cubic inch of material volume. The wet and dry towels can be color coded. An indicator flag or other device can be provided in a window on the dispenser, if desired, to alert service or maintenance people when there is a need to replenish towels.

The present invention should be very beneficial in restaurants, laboratories, hospitals, nursing homes, retirement homes, child day care centers, restrooms, and all other locations where the cleaning and sanitizing of hands is desirable. Thus, with the present invention it is possible to be assured that there is ample opportunity for anyone to cleanse their hands upon entering or before leaving a room where infectious agents may have been handled. The arrangement of the slide block 70 and attendant parts lends itself to operation by a powered linear actuator such as a pneumatic cylinder or solenoid, either of which might be pedal-switch actuated, sound or voice switch actuated or otherwise remotely actuated to obviate the touching of a hand-operated push pad to initiate the dispensing function.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A towel dispenser comprising:

a housing;

first storage means in said housing to store toweling to be dispensed;

release means operable, when actuated, to release toweling from said storage means;

wetting means associated with said storage means for wetting a towel released from said storage means, and means for dispensing wet and dry toweling substantially simultaneously from said housing;

said storage means including a first roll of dry toweling to be dispensed wet, and a second roll of dry toweling to be dispensed dry; and the toweling material in said first roll being less absorbent per square inch than the toweling material in said second roll.

2. A towel dispenser comprising:

a housing;

storage means in said housing to store toweling to be dispensed;

release means operable, when actuated, to release toweling from said storage means;

wetting means associated with said storage means for wetting a towel released from said storage means;

a towel dispensing station at said housing;

guide means associated with said toweling from said storage means and guiding said toweling to said dispensing station;

said wetting means including a container holding a wetting agent;

said guide means including a wetting roller guiding said toweling from said storage means;

said guide means including a cam operatively associated with said wetting roller and operable, when actuated by the release means, to force both said wetting roller and a portion of toweling from said storage means engaged by said wetting roller into said wetting agent in said container.

3. A towel dispenser comprising:

a housing;

first storage means in said housing to store toweling to be dispensed;

release means operable, when actuated, to release toweling from said storage means;

wetting means associated with said storage means for wetting a towel released from said storage means, and means for dispensing wet and dry toweling substantially simultaneously from said housing;

said storage means including a first roll of dry toweling to be dispensed wet, and a second roll of dry toweling to be dispensed dry; and the toweling material in said first roll being less absorbent per cubic inch than is the toweling material in said second roll.

4. The dispenser of claim 3 wherein:

the toweling material in said second roll contains a skin emollient.

5. A method of dispensing toweling and comprising the steps of:

responding to an initiating signal to present at designated stations, an exposed edge of toweling from a first supply and an exposed edge of toweling from a second supply; and delivering predetermined lengths of toweling from said first supply and from said second supply in response to pulling one of said exposed edges of toweling.

6. The method of claim 5 and further comprising the steps of:

presenting the exposed edge from the first supply at a designated station in front of the exposed edge from said second supply.

7. The method of claim 6 and further comprising the steps of:

wetting a major portion of said predetermined length of toweling from said first supply as said one edge is pulled.

8. The method of claim 7 and further comprising the step of:

tearing off said predetermined length of toweling from said first supply.

9. The method of claim 8 and further comprising the step of:

leaving unwetted and unexposed, the toweling between said first supply and the predetermined length torn off from said first supply.

10. A towel dispenser comprising:

a housing;

storage means in said housing to store toweling to be dispensed;

wetting means associated with said storage means for wetting toweling released from said storage means;

a towel dispensing station at said housing;

guide means associated with said toweling released from said storage means and guiding said toweling to said dispensing station;

said wetting means including a container holding a wetting agent;

said guide means including a wetting roller guiding said toweling from said storage means;

toweling advancer means coupled to toweling released from said storage means and operable, when actuated, to advance a first measured amount of toweling to said dispensing station from said storage means, and then to enable a further measured amounts of toweling to be freely pulled from said housing.

11. The dispenser of claim 10 and further comprising:

cam means operable during initial operation of said advancer means and during completion of the pulling of toweling from said storage means to disable the wetting means from wetting toweling dispensed from said storage means.

12. The dispenser of claim 10 and further comprising:

a toweling cut-off member; and toweling clamp means co-operable with said cut-off member and normally clamping said toweling against said member to facilitate cut-off, but operable by said advancer means to release the clamp means from clamping the toweling.

13. The dispenser of claim 12 and wherein said advancer means includes:

a towel feed drive roller engaging toweling released from said storage means;

a manually engageable push pad at the exterior of said housing;

an advance pawl coupled to said push pad;

drive rotor means operatively associated with said pawl and rotatable by said pawl when said push pad is pushed at least 1.0 inches to cause towel feed; and a roller drive belt coupled to said drive rotor means and said drive roller to feed and dispense said first measured amount of at least 0.9 inches in response to the pushing of said push pad at least 1.25 inches.

14. The dispenser of claim 13 and wherein:

said guide means include a cam operatively associated with said wetting roller and operable, when said push pad is pushed at least 1.0 inches, to force said wetting roller and a portion of toweling obtained from said storage means into said wetting agent in said container.

15. A towel dispenser comprising:

a housing;

first storage means in said housing to store toweling to be dispensed;

release means operable, when actuated, to release toweling from said storage means;

wetting means associated with said storage means for wetting a towel released from said storage means, and means for dispensing wet and dry toweling substantially simultaneously from said housing;

a wet towel dispensing station associated with said storage means and a dry towel dispensing station associated with said storage means, said wet towel dispensing station being located in front of said dry towel dispensing station.

16. The dispenser of claim 15 and wherein:

the dry towel dispensing station is at a lower elevation than is the wet towel dispensing station.

17. The dispenser of claim 15 and further comprising:

a first roll of toweling to be dispensed wet;

a second roll of toweling to be dispensed dry;

roll release and advancer means coupled to toweling delivered by said first and second rolls and operable, when actuated, to first dispense first measured amounts of toweling from both of said rolls, and to enable further measured amounts of toweling to be pulled from said rolls.

18. The dispenser of claim 17 and wherein:

said roll release and advancer means include a push pad at the front of the housing and facing the user of the dispenser.

19. The dispenser of claim 18 and further comprising:

synchronizing means coupled to the toweling from said first roll and to the toweling from said second roll and operable, when said release means enable further measured amounts to be pulled from said rolls, to cause toweling to be dispensed from one of said rolls when toweling is pulled from the other of said rolls.

20. The dispenser of claim 19 and further comprising:

cam means operable during initial operation of said release and advancer means and during completion of the pulling of toweling from one of said rolls to disable the wetting means from wetting toweling dispensed from said first roll.

21. The dispenser of claim 20 wherein:

said rolls are mounted with their axes horizontal and their axes are maintained horizontal during dispensing.

22. A towel dispenser comprising:

a housing;

first storage means in said housing to store toweling to be dispensed;

release means operable, when actuated, to release toweling from said storage means;

wetting means associated with said storage means for wetting a towel released from said storage means, and means for dispensing wet and dry toweling substantially simultaneously from said housing;

said storage means including a first roll of dry toweling to be dispensed wet, and a second roll of dry toweling to be dispensed dry; and first guide means associated with toweling from said first roll and guiding said toweling to said wet towel dispensing station;

said wetting means including a container holding a wetting agent; and said first guide means including a wetting roller guiding said toweling from said first roll into said wetting means.

23. The dispenser of claim 22 and wherein:

said first guide means include a cam operatively associated with said wetting roller and operable, when actuated, to force both said wetting roller and a portion of said first roll toweling engaged by said wetting roller into said wetting agent in said container.

24. The dispenser of claim 22 and further comprising:

roll release and advancer means coupled to toweling delivered by said first and second rolls and operable, when actuated, to first dispense first measured amounts of toweling from both of said rolls, and to enable further measured amounts of toweling to be pulled from said housing.

25. The dispenser of claim 24 and further comprising:

toweling cut-off members; and toweling clamp means co-operable with said members and normally clamping said toweling against said members to facilitate cut-off but operable by said roll release and advancer means to release the clamp means from clamping the toweling.

26. The dispenser of claim 24 and wherein said release and advancer means includes:

a first towel feed drive roller engaging toweling released from said first roll, a second towel feed drive roller engaging toweling from said second roll;

a manually engageable push pad at the exterior of said housing;

an advance pawl coupled to said push pad;

drive rotor means operatively associated with said pawl and rotatable by said pawl when said push pad is pushed at least 1.0 inches to cause towel feed;

a roller drive belt coupled to said drive rotor means and said drive rollers to feed and dispense said first measured amounts of at least 0.9 inches in response to the pushing of said push pad at least 1.25 inches.

27. The dispenser of claim 26 and wherein:

said first guide means include a cam operatively associated with said wetting roller and operable, when said push pad is pushed at least 1.0 inches, to force both said wetting roller and a portion of toweling obtained from said first roll into said wetting agent in said container.

28. The dispenser of claim 27 and wherein:

said wetting agent container is below said rolls; and said release and advancer means further include:

a release latch;

a detent on said drive rotor means;

said release latch having a lug thereon engaging said drive rotor means and receivable in said detent when said latch is in a latching position to prevent rotation of said drive rotor means and thereby prevent rotation of said feed rollers;

a second cam coupled to said push pad;

a cam follower on said release latch and operable by said second cam when said push pad is pushed to force said latch out of said latching position to remove said lug from said detent and release said drive rotor means.

29. The dispenser of claim 28 and wherein:

said pawl and said latch are so related to said drive rotor means that there is some lost motion of said pawl during pushing of said pad before rotation of said drive rotor means and said feed rollers commences.

* * * * *